US005314610A

United States Patent [19]

Gartside

[11] Patent Number: 5,314,610

[45] Date of Patent: May 24, 1994

[54] STAGED CATALYTIC CRACKING PROCESS

[75] Inventor: Robert J. Gartside, Summit, N.J.

[73] Assignee: ABB Lummus Crest Inc., Bloomfield, N.J.

[21] Appl. No.: 890,196

[22] Filed: May 29, 1992

[51] Int. Cl.[5] ..... C10G 51/06; C10G 11/00

[52] U.S. Cl. ..... 208/80; 208/74; 208/78; 208/113; 208/155

[58] Field of Search ..... 208/72, 73, 74, 78, 208/80, 113, 155; 422/141, 142

[56] References Cited

U.S. PATENT DOCUMENTS

| | | | |
|---|---|---|---|
| 3,186,805 | 6/1965 | Gomory | 422/111 |
| 3,246,960 | 4/1966 | Sharp et al. | 422/214 |
| 3,246,978 | 4/1966 | Porter et al. | 75/450 |
| 3,406,112 | 10/1968 | Bowles | 208/153 |
| 3,617,496 | 11/1971 | Bryson | 208/80 |
| 4,288,235 | 9/1981 | Gartside et al. | 55/196 |
| 4,422,925 | 12/1983 | Williams et al. | 208/75 |
| 4,435,279 | 3/1984 | Busch et al. | 208/111 |
| 4,455,220 | 6/1984 | Parker et al. | 208/161 |
| 4,502,947 | 3/1985 | Haddad et al. | 208/161 |
| 4,606,810 | 8/1986 | Krambeck et al. | 208/74 |
| 4,624,771 | 11/1986 | Lane et al. | 208/74 |
| 4,666,674 | 5/1987 | Barnes | 422/144 |
| 4,749,471 | 6/1988 | Kam et al. | 208/113 |
| 4,925,632 | 5/1990 | Thacker et al. | 422/142 |
| 4,999,100 | 3/1991 | Thacker et al. | 208/155 |
| 5,019,354 | 5/1991 | Chan | 422/145 |
| 5,053,204 | 10/1991 | Herbst et al. | 422/213 |
| 5,064,622 | 11/1991 | Cabrera | 422/144 |

OTHER PUBLICATIONS

"Fluid Catalytic Cracking Report" by Amos A. Avidan, Michael Edwards and Hartley Owen, Oil and Gas Journal, Jan. 8, 1990, pp. 33 to 58.

*Primary Examiner*—R. Bruce Breneman
*Assistant Examiner*—Walter D. Griffin
*Attorney, Agent, or Firm*—Chilton, Alix & Van Kirk

[57] ABSTRACT

A staged catalytic cracking process and apparatus is disclosed where each stage has a catalyst to oil ratio of at least 15 and there are individual hydrocarbon feeds to each stage and product removal from each stage. There is a residence time profile with the first stage having a short residence time and the successive stages having progressively longer residence times. Further, there is a feed profile with the lighter components of the total feed going to the first stage and the heavier components being fed to the later stages. The apparatus has a generally vertical orientation which permits it to be incorporated into existing cracking units for upgrading and also easily provides for both short and long residence times.

15 Claims, 3 Drawing Sheets

STAGED CATALYTIC CRACKING PROCESS

BACKGROUND OF THE INVENTION

1. Field of the Invention

This invention relates to the cracking of hydrocarbons and more particularly to a method and apparatus which utilize fluidized catalytic cracking processes.

2. Description of the Prior Art

In a petroleum refining operation, large hydrocarbon molecules are cracked into smaller molecules for the production of motor fuels such as gasoline, jet fuel, kerosene and diesel fuel. This process is usually carried out in a fluidized catalytic cracker in which the catalyst in powdered or granular form can be effectively contacted with the heavy petroleum feedstock.

In a typical fluidized catalytic cracking process, the hydrocarbon feedstock and hot regenerated catalyst are injected into the base of an elongated riser. In some cases, fluidizing gas is used to increase the dispersion of the solids and improve the contacting of the feedstock and catalyst powder. The fluidized suspension passes upwardly through the riser where reaction occurs. The riser terminates in a reaction vessel where catalyst and hydrocarbon effluent are separated in a primary separation zone. The hydrocarbon passes through a cyclone separation device to remove the remaining particulate solid catalyst and then goes to product separation. The spent catalyst is collected in the base of the reaction vessel, stripped of residual hydrocarbon vapors with steam, and then passed to a regeneration section.

There are a number of means of making the primary separation of the hydrocarbon and solids in the reaction vessel. The simplest means is to simply exit into a vessel of sufficient diameter that the resultant gas velocity is insufficient to carry the solids which then fall to the bottom of the vessel where they are stripped of residual hydrocarbons. As reaction temperatures increase, there is a desire to reduce thermal reactions that continue even after the hydrocarbons are separated. Thus more rapid primary separation is desired. Many devices have been commercialized to affect a more rapid separation including rough cut cyclones, inverted "top hats", slotted risers, closed coupled cyclones, etc. The general characteristic of all of these devices is rapid separation and/or controlled effluent gas removal, possibly including quenching of the gases via the addition of various other cooler streams. These technologies are well known to those skilled in the art.

In the regeneration section, coke deposited during the reaction and any unstripped hydrocarbons are combusted with oxygen containing gases. The regeneration serves to reheat the solids and remove any residual coke deposits to restore catalytic activity. In general, the amount of combustible hydrocarbons that enter the regenerator are a function of the severity of the cracking reaction, the specific gravity and character of the feedstock, and the circulation rate of solids. The cracking severity defines the amount of coke deposited. Heavier and/or more aromatic feedstocks tend to deposit more coke at a given reaction severity. Higher solids circulation rates tend to carry more unstripped hydrocarbons into the regeneration zone. Not only do these hydrocarbons represent fuel ("circulation coke") but given the higher hydrogen content of the unstripped hydrocarbons, their heating value is greater than deposited coke. This leads to overheating of the solids and possible thermal deactivation.

There are many variations of regeneration systems for catalytic cracking. In some cases, a single stage combustion is used. In others, variations in contacting zones and or fluid dynamic conditions are used to provide specific benefits such as reducing peak temperatures during combustion, improve air/catalyst contacting, reducing net heat release to the solids, etc. In other variations, two separate combustion zones are used with separate air contacting in each. These are known to those skilled in the art and a few examples are U.S. Pat. No. 2,852,443, U.S. Pat. No. 3,909,392, U.S. Pat. No. 3,919,115.

Following the regeneration, the reheated solids are stripped of combustion products prior to being recycled to the riser reactor. Hydrocarbon feedstock is introduced into the base of the riser. Many different nozzle injection systems are used in commercial practice. The reaction proceeds as the fluidized mixture flows through the riser. The riser geometry sets the system residence time.

A fluidized catalytic cracking process operates in heat balance. The heat required for the endothermic heat of reaction is supplied by the fuel (coke and/or unstripped hydrocarbons) that flows to the regeneration section from the reaction section. If the fuel is insufficient for the desired conversion, the regeneration temperature will drop and the system will gradually reduce conversion to where the fuel equals the demand in the reactor. Conversely, if the fuel from the reactor is excessive, the catalyst will return to the reaction section incompletely regenerated (still fouled). The coke deposits on the catalyst cover active sites and thus effectively reduce the catalytic activity of the solids. In this case, conversions will fall until the system again reaches heat balance.

The principal desired products from a fluidized catalytic cracking process are diesel oils, gasolines, and C3 to C5 compounds, particularly isoparaffins and isoolefins as opposed to normal paraffins and olefins. Heavy fuel oils and light gases have value principally as low cost fuels and thus do not add appreciable value to the process.

The total reaction in any fluidized catalytic cracking reactor is a summation of thermal and catalytic reactions. Thermal reactions are driven by temperature. The products of thermal reactions contain high percentages of less valuable C2 and lighter compounds by the very nature of the cracking kinetics. Thermal reactions proceed whether or not solids are present and are suppressed only by lowering the temperatures of the reaction.

Catalytic reactions on the other hand are driven by a combination of temperature, the number of catalytic sites involved in the reaction and the activity of each individual site. The products of the catalytic reactions are principally diesel oils, gasolines, and C3 to C5 compounds. Further, the C3 to C5 compounds formed have a high percentage of desired iso compounds due to the inherent isomerization activity of the typical zeolitic acidic cracking catalysts.

Increasing the catalyst to oil ratio in the process will increase the catalytic conversion at constant temperature while the extent of the thermal reactions will remain the same. Thus high catalyst to oil cracking will result in a higher conversion at any given temperature with the increase being due to catalytic reactions. Thus the effluent yield will show a higher percentage of total products due to the catalytic reactions.

In order to maximize the production of gasolines and olefins, high conversions of feedstock are desired. In order to achieve high conversions, operators of fluidized catalytic cracking units have attempted to increase both catalyst to oil (C/O) ratios and operating temperatures. There are however, limits to the extent that this can be done in single riser units. Higher temperatures will result in higher thermal products which negatively affect economics. Higher C/O ratios will increase conversion at constant temperature but will bring increased quantities of unstripped hydrocarbons into the regeneration zone. In fact the quantity of unstripped hydrocarbons is proportional to the solids circulation rate. This will result in more fuel to the regenerator and higher solids temperatures. Higher solids temperatures will increase reaction outlet temperature at the higher circulation rates which leads to even higher light gas production. The only way to achieve high C/O ratio cracking in a conventional single riser system is to remove heat from the regenerator.

Two stage regeneration as described above is one means of reducing solids temperature at constant fuel. Alternately, heat removal via steam generation can be used. Both of these options are practiced commercially.

It is obvious from the above that the operator of a conventional fluidized catalytic cracking unit is limited in the ability to process a hydrocarbon feed at high catalytic conversions at low temperatures in order to both maximize the "catalytic content" of the yields (isomerization), achieve high feedstock conversions, and minimize the unwanted thermal products.

Operators are often faced with an additional problem. In a refinery there are typically a wide range of feedstocks that vary in specific gravity, boiling range, and composition. These will exhibit varying performance in a fluidized catalytic cracking reactor. It is well known that the lighter feedstocks (e.g. naphthas with boiling ranges from 38°-204° C.) require higher reaction severity in order to crack in comparison to vacuum gas oils for example. In order to process a number of feedstocks in a single unit, various processes have been developed to stage the feedstocks to the riser. This involves feeding the lighter, lower molecular weight portion of the feedstock which is more difficult to crack to the bottom of the riser and feeding the heavier, higher molecular weight portion to a higher point in the riser. In this regard, reference is made to U.S. Pat. Nos. 4,624,771, 4,435,279 and 3,186,805.

All of the above mentioned staged processes have a common feature. The effluent from the first feedstock contacting stage (lower portion of the riser) passes in its entirety to the second stage. Thus the feedstock feed to the first stage of the unit sees the entire residence time of the riser and the subsequent feeds see progressively shorter residence times as they are introduced higher and higher in the riser. Further, for a given catalyst circulation rate, the first feed sees the highest C/O ratio at the highest solids temperatures. It thus experiences the highest severity. Subsequent feedstocks however see progressively lower C/O ratios and lower temperatures as more feed is introduced and as the endothermic reactions reduce the reaction temperature. Further, each time the catalyst is contacted with a feedstock, fouling of the catalyst takes place. The extent of fouling depends upon the severity of the reaction (time and temperature) and the nature of the feedstock. Thus the last feed sees the lowest C/O, the lowest temperature, and a less active catalyst since reaction has been occurring up to that point. Operation of these types of staged systems leads to wide distributions in yields from each feed due to wide differences in reaction severity for the initial feed and final feed. The wide differences in conversions for the feeds leads to a non-optimal product yield spectrum consisting of some portions of overcracked and some portions of undercracked materials.

Another development in the field of fluidized catalytic cracking is represented by U.S. Pat. Nos. 4,925,632 and 4,999,100. These patents relate to what is referred to as a low profile fluid catalytic cracking process and apparatus wherein there is a succession of low profile catalyst chambers each containing a reservoir of catalyst and alternately connected in sequence by openings below the catalyst level and above the catalyst level. The catalyst in all chambers is fluidized by gas flowing upwardly through each chamber.

This process is a staged process that differs from the ones cited above. In this scheme, there are truly separate stages where hydrocarbon feedstock contacts catalyst and then is separated from that catalyst. The effluent gases are sent for further processing and the solids continue to the next stage where they contact a second feedstock.

The patents teach that a such a staged process will allow operation at a lower overall C/O ratio than a single riser system. The patent details a number of advantages all of which relate to operation at effectively lower catalyst circulation rates per unit of hydrocarbon processed. Lower circulation rates minimize the requirements for tall vessels to provide pressure for circulation. The lower circulation rates lead to lower fuel to the regenerator. The reduced circulation rates also reduce catalyst attrition and vessel erosion, both known to be a function of catalyst circulation. In addition, the lower vessels lend themselves to shorter residence times for reaction (shorter risers) which can improve yields.

The lower catalyst circulation rates are achieved by two means. First, the staged introduction of feeds with effluent separation between stages creates separate zones where a reduced net solids flow contacting only a portion of the feed results in a C/O ratio equivalent to a conventional unit but higher than that based upon total feed and catalyst flows. Secondly, the process utilizes common walls between reactors and regenerators to allow for indirect heat transfer from the hotter regeneration section to the reaction section. This minimizes the amount of solids circulation required to provide heat.

SUMMARY OF THE INVENTION

The present invention is directed to an improved staged catalytic cracking process and apparatus in which each stage of the process is operated in a manner to maximize the catalyst to oil ratio in that stage and thus achieve high conversions at the same temperature or similar conversions at lower temperatures. The C/O ratio per stage is at least 15. It is an object of the invention to operate at overall C/O ratios comparable to those found in existing single riser systems (7 to 10) which will thus create high C/O ratios per stage. The invention further includes the control of the degree of conversion in each stage to avoid over-conversion that would result in excessive catalyst fouling and deactivation in that stage. The invention also includes a residence time profile with the first stage having a short residence time and the next stages having longer residence times and may further include a feed profile where the light components are fed to the first stage and the heavier components to later stages. The invention provides for a relatively consistent degree of conversion in each of the stages to maximize product selectivity. The apparatus provides a means to allow for different residence times for different feedstocks within a staged process including varying the vertical heights of risers. The apparatus can easily incorporate a staged cracking into existing fluidized catalytic cracking equipment with a vertical orientation with bed pressure developed for higher residence times (longer risers) in latter stages.

DETAILED DESCRIPTION OF THE PREFERRED EMBODIMENTS

Figure 1:
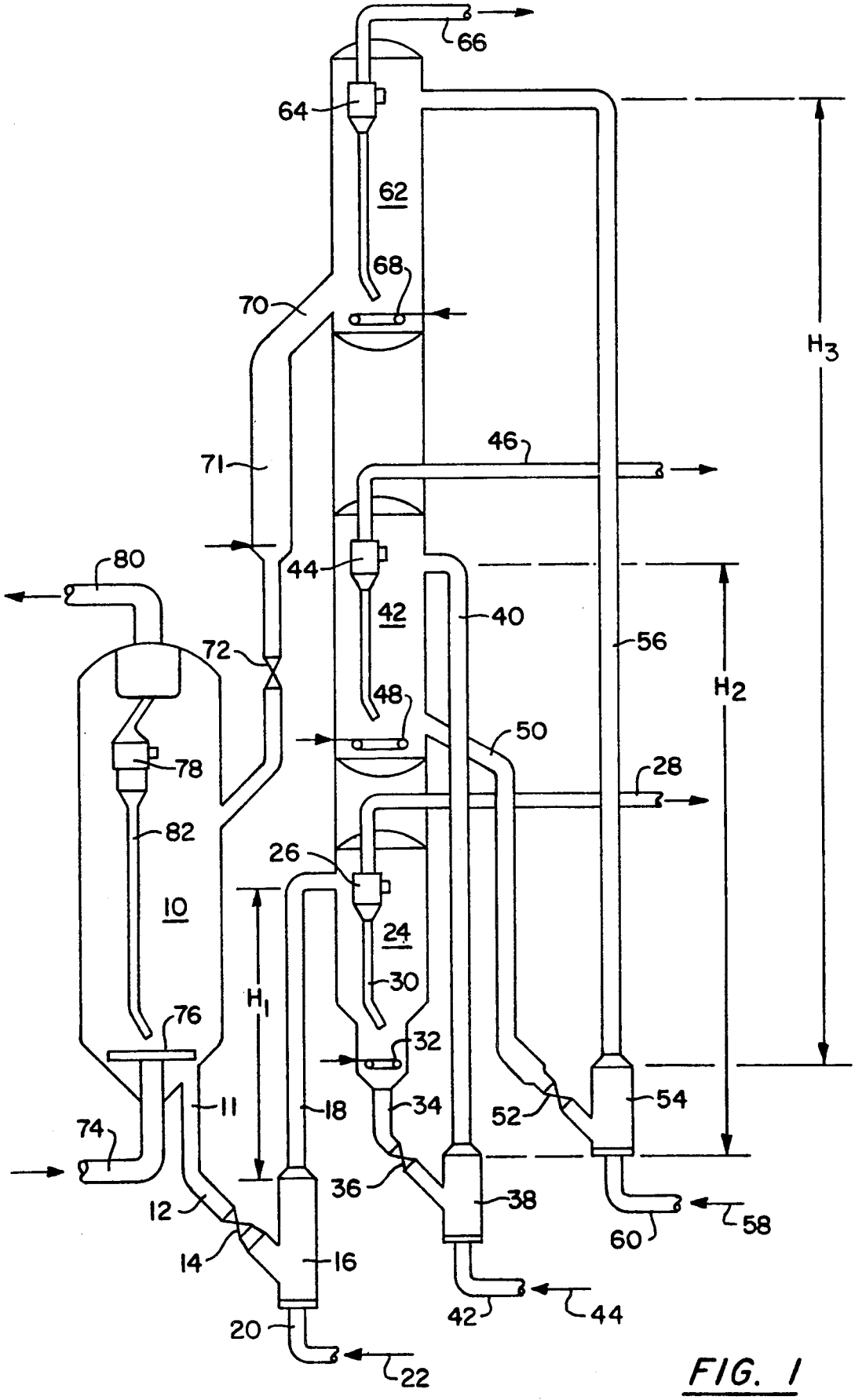
FIG. 1 is a diagrammatic representation of a fluid catalytic cracking system incorporating the teachings of the present invention.

An illustration of the process and apparatus of the present invention is shown in FIG. 1. Beginning with the regenerator 10, a hot, clean, freshly regenerated catalyst is delivered through stripping section 11 where stripping steam is introduced and then by line 12 through control valve 14 into the lower end 16 for the riser-reactor 18. Injected into the lower end 16 through line 20, is the first hydrocarbon feed 22 and, if desired or necessary, a fluidizing medium such as steam, nitrogen or light hydrocarbons. As will be discussed later, the first hydrocarbon feed 22 is the lightest fraction, such as the naphtha fraction, of the total hydrocarbon feed if a feed profile is used.

The expanding gases from the feed (and the fluidizing medium if present) convey the catalyst up the riser 18 and into the reaction vessel 24. As the catalyst and feed pass up the riser, which has a length of $H_1$, the hydrocarbon feed cracks into lower boiling hydrocarbon products. The ratio of catalyst to hydrocarbon feed in the riser 18 is at least 15 (weight of catalyst per weight of feed). The riser 18 discharges the catalyst and cracked hydrocarbon into a primary separation zone in the reactor vessel 24. The majority of the solids are separated from the gases and fall into the lower portion of reactor 24. The majority of the hydrocarbon vapors then typically enter the cyclone separator 26. In the cyclone separator, the vapors are separated from any entrained catalyst and exit the reactor 24 through conduit 28 while the remaining catalyst is directed to the lower portion of the reactor 24 through the dip leg 30. The catalyst collects in the lower portion of the reactor 24 forming a bed of catalyst. Steam is fed into the bed of catalyst through distributor 32 which then rises up through the bed of catalyst stripping entrained or absorbed hydrocarbon from the catalyst. The steam and stripped hydrocarbons then flow up and into the cyclone separator 26 and are discharged through conduit 28. Stripping mediums other than steam could be used such as nitrogen.

The catalyst from the bed of catalyst in reactor 24 is discharged through conduit 34. A control valve 36 controls the flow of this catalyst into the lower end 38 of the riser-reactor 40. Injected into this lower end 38 through line 42 is the second hydrocarbon feed 44. Once again, a fluidizing medium such as steam may also be injected. This second hydrocarbon feed 44 is an intermediate fraction of the total feed, such as the gas oil fraction, if a feed profile is used.

Once again, as the expanding gases from this second hydrocarbon feed (and the fluidizing medium if present) convey the catalyst up the riser 40, the hydrocarbon feed cracks. This riser 40 has a length of $H_2$. The ratio of catalyst to hydrocarbon feed is again at least 15. The riser 40 discharges the catalyst and cracked gases into the reactor 42. As in reactor 24, the cracked hydrocarbon vapors and catalyst are separated through the cyclone separator 44 with the product vapors exiting through conduit 46. Hydrocarbons are stripped by steam or other stripping medium fed through distributor 48.

The catalyst from the bed of catalyst in reactor 42 is discharged through conduit 50 and control valve 52 into the lower portion 54 of the riser reactor 56 which has a length of $H_3$. The third hydrocarbon feed 58, together with any fluidizing medium, is fed into this lower portion 54 through conduit 60. The ratio of catalyst to hydrogen feed is at least 15 as in the previous stages. The riser 56 discharges into the reactor 62 and the catalyst and cracked gases are separated through the cyclone separator 64 with the product vapors exiting through conduit 66. Hydrocarbons are stripped by steam or other stripping medium fed through distributor 68. The spent catalyst is discharged from the reactor 62 through conduit 70 and stripping section 71 where steam is introduced. The catalyst then goes through control valve 72 and into the regenerator 10.

In the regenerator 10, air or oxygen or a mixture thereof is introduced through conduit 74. The coke is removed from the catalyst by combustion with oxygen from distributor 76. The combustion by-products rise upwardly along with any entrained catalyst and into the cyclone separator 78. The catalyst is separated from the products of combustion, which are discharged through conduit 80 with the catalyst being returned to the catalyst bed through dip leg 82. The burning of the coke heats the catalyst back up to the required cracking temperature and the catalyst is then once again discharged through conduit 12.

As previously stated, the total reaction in any fluidized catalytic cracking is a summation of thermal and catalytic reactions. Thermal reactions are driven by temperature and catalytic reactions are a function of both temperature level and catalytic sites. The current trend is to produce reformulated gasoline which has reduced aromatics and an increased oxygen content in the form of methyltertiary butyl ether (MTBE) and tertiary amyl methyl ether (TAME). To provide a fluidized catalytic cracking product suitable for the subsequent production of MTBE and TAME, the cracking process must favor the production of iso olefins. To produce more olefins, the process must be operated at higher temperatures and shorter reaction times. However, merely operating at higher temperatures favors thermal cracking and the production of free radicals and $C_2$ and lighter products. Catalytic cracking favors the production of carbonium ions which favor isomerization. The desired reaction, therefore is a reaction at moderate temperature, with short residence times and with high catalyst to feedstock (oil) ratios. With a higher catalyst to oil ratio (C/O) at a given heat balance, there will be a greater amount of catalytic reactions compared to thermal reactions. Furthermore, there will be higher conversions at any given temperature. The catalytic reactions are preferred since they provide isomerization and result in the desired $C_3$ and iso $C_4$ and $C_5$ compounds as opposed to the thermal reaction products of $C_2$ and lighter compounds.

Figure 2:
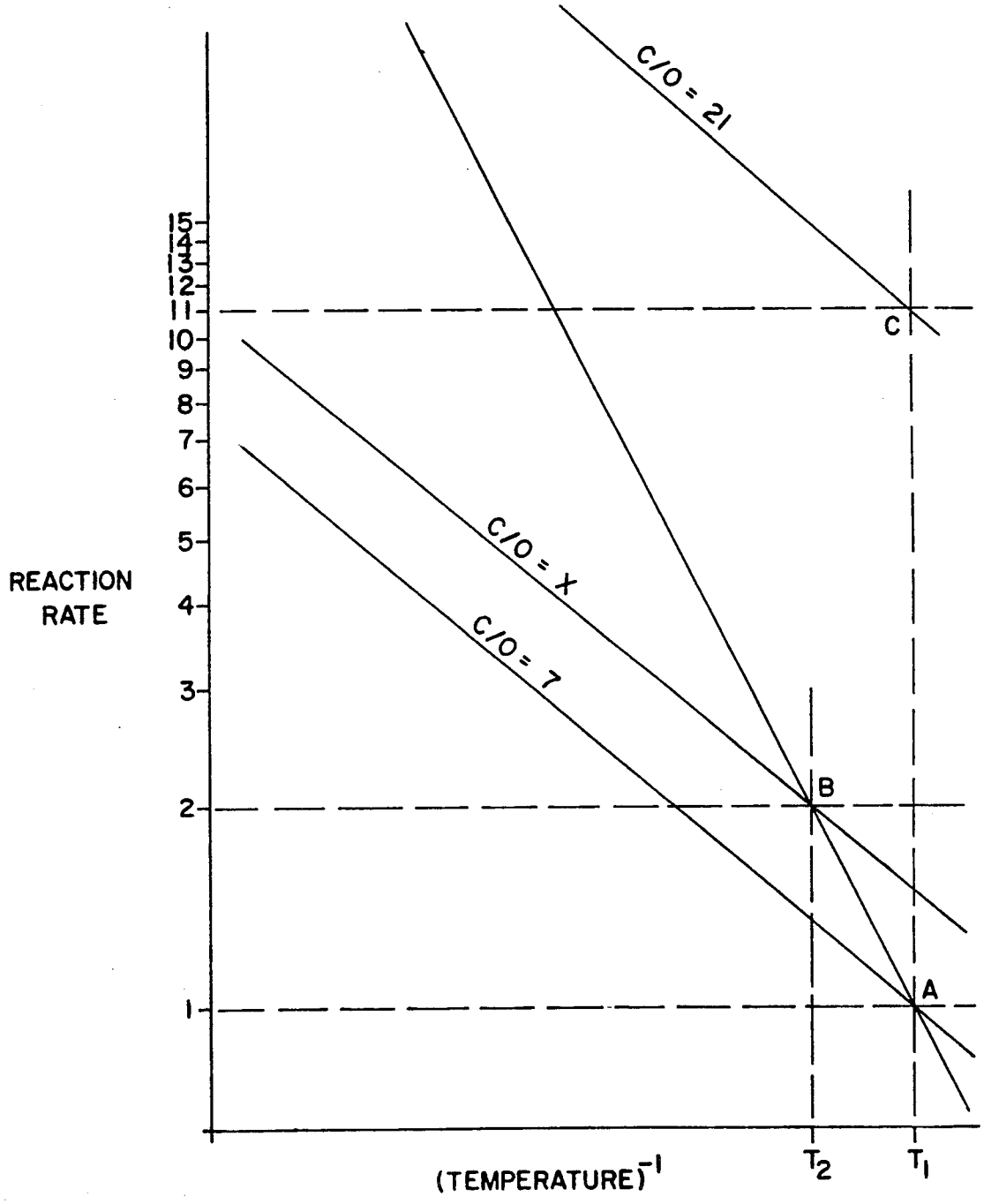
FIG. 2 is a graphical presentation of the relationship between temperature and reaction rate at various catalyst to oil ratios for both thermal and catalytic reactions.

FIG. 2 is a graphical representation of the relationship between kinetic reaction rate and temperature for both thermal and catalytic reactions. In general, thermal reaction rate increases more rapidly with increased temperature than do catalytic reactions. Thus, increasing temperature to increase conversion increases thermal reaction product formation more quickly than the desired catalytic product formation (e.g., isoparaffins and isoolefins). As discussed however, in a conventional system, increasing C/O ratio as a means of increasing conversion will result in a simultaneous increase in solids temperature due to increased fuel to the regenerator.

Consider first a single riser system operated at a C/O ratio of 7 and temperature $T_1$ at operating point A. The total reaction rate is the sum of the thermal rate (1) and the catalytic rate (1) for an overall rate of 2 units. Increasing the C/O ratio to X still in a single riser system would move the operating point to B at an increased temperature of $T_2$. The resultant overall rate would be approximately 4 (2 thermal and 2 catalytic). The products would still be proportionately 50% thermal based and 50% catalytic based. Turning now to the invention using as an example a C/O ratio of 21 in each of three stages where the overall C/O ratio would remain at 7, and where the same solids inlet temperature of $T_1$ is used, the operating point would move to C. The rate is now 11 units catalytic and 1 unit thermal so that there is over 90% of the rate due to catalytic reactions.

In the process of the present invention, there is a high C/O ratio in each stage of at least 15 and preferably about 21. As previously stated, the invention operates at overall C/O ratios comparable to single riser systems which will create high C/O ratios per stage. Operating at lower C/O ratios has been found to be uneconomical. Since there is independent staging with only a portion of the total feed going to each stage and with product removal from each stage, it can be seen that the amount of feed to each stage is small as compared to the amount of catalyst flowing through the system. It can be seen that this results in a high C/O ratio in each reactor while maintaining a lower C/O ratio based upon the total feed and solids circulated. Also, because of the arrangement of the equipment the residence time in each stage is controlled by the length (and volume) of each of the risers. As illustrated in the drawing by way of example, riser 40 is about one and a half times as long as riser 18 and riser 56 is about three times as long as riser 18. This provides a residence time profile which is preferably 1.0 seconds in riser 18, 1.5 seconds in riser 40 and 3 seconds in riser 56. These times are only by way of example and variations can be made depending on the particular situation such as the feed composition. Also, the invention has been illustrated in FIG. 1 showing three stages. However, the process can be practiced with only two stages or with more than three stages.

The C/O in each stage is at least 15 as previously stated and is preferably in the range of 21. Since the catalyst flows through the entire system the overall C/O will be one third of the individual stage C/O for a three stage system. This example assumes equal feed flow per stage. Variations in feed flow in each stage can be used without departing from the spirit of the invention. Also, the residence time for each of the separate feeds is short since it only passes through that one stage unlike a single riser staged system where the initial feed passes through all subsequent stages. The reduced residence time will reduce secondary hydrogen transfer reactions thus favoring the production of olefins and reducing the production of aromatics. Also, the shorter residence times reduce the degradation of product when operating at the higher temperatures which are used to maximize the olefin production. The high C/O ratio means that the amount of thermal cracking is kept low as compared to the amount of catalytic cracking. The higher C/O operation of the staged system of the invention can be used in two ways. Higher C/O can be used to achieve higher conversions and higher catalytic content at the same temperature compared to a conventional single riser system. Alternately, the higher C/O ratio operation can be used to achieve similar conversions at lower temperatures while minimizing thermal reactions.

As an example of the present invention as compared to various prior art systems, the following Tables present data to compare systems and results. Table 1 relates to a conventional catalytic cracker system with a single riser and a single feed of vacuum gas oil at various temperatures and C/O ratios. It shows the typical relationship between conversion and both reaction temperature and C/O ratio. The residence time is held constant at 2 seconds. Note that there would be many variations in specific yields as a function of feedstock and catalyst type. These examples have been constructed based upon a constant solids inlet temperature. As can be seen, increasing the C/O ratio results in an increase in reaction outlet temperature at a constant solids temperature in addition to increasing the catalytic reactions. This is true for all systems since there is a higher amount of heat being carried into the reaction zone by solids, some of which ends up as sensible heat of the products.

TABLE 1

| | Conventional Single Riser Cracking | | | | | |
|---|---|---|---|---|---|---|
| Feed | Gas Oil | Gas Oil | Gas Oil | Gas Oil | Gas Oil | Gas Oil |
| C/O Ratio | 7 | 7 | 7 | 10 | 10 | 12 |
| T of Solids In-°C. | 600 | 625 | 700 | 650 | 700 | 725 |
| T of Reaction-°C. | 472 | 497 | 572 | 553 | 603 | 642 |
| Residence Time Sec. | 2 | 2 | 2 | 2 | 2 | 2 |
| Conversion | 0.575 | 0.630 | 0.758 | 0.803 | 0.854 | 0.902 |

It can be seen that an increase in C/O increases the conversion considerably. Also, it can be seen that an increase in temperature also increases conversion. The following Tables 2 and 3 relate to the process and system disclosed in U.S. Pat. Nos. 4,925,632 and 4,999,100. Table 2 is for a solids inlet temperature of 600° C. while Table 3 is for a solids inlet temperature of 700° C. The example assumes a three stage system with an overall C/O ratio of 4.0 which is lower than the C/O ratios for the single riser to achieve the objectives of lower height, attrition, and erosion.

TABLE 2

| Low C/O Staged Cracking Overall C/O = 4 Inlets Solids T = 600° C. | | | |
|---|---|---|---|
| Stage | 1 | 2 | 3 |
| Feed | Gas Oil | Gas Oil | Gas Oil |
| C/O Ratio Per Stage | 12 | 12 | 12 |
| T of Solids In-°C. | 600 | 517 | 433 |
| T of Reaction-°C. | 517 | 433 | 350 |
| Residence Time-Sec | 2 | 2 | 2 |
| Conversion | 0.787 | 0.582 | 0.298 |
| Average Conversion | | 0.555 | |

TABLE 3

| Low C/O Staged Cracking Overall C/O = 4 Inlet Solids T = 700° C. | | | |
|---|---|---|---|
| Stage | 1 | 2 | 3 |
| Feed | Gas Oil | Gas Oil | Gas Oil |
| C/O Ratio Per Stage | 12 | 12 | 12 |
| T of Solids In-°C. | 700 | 617 | 533 |
| T of Reaction-°C. | 617 | 533 | 450 |
| Residence Time-Sec | 2 | 2 | 2 |
| Conversion | 0.887 | 0.779 | 0.579 |
| Average Conversion | | 0.748 | |

It can be seen that the increase in temperature as in Table 3 increases the conversion over the process of Table 2 at a lower temperature. It can also be seen that the conversion at any particular temperature is essentially the same as for the single riser process of Table 1. For example, the conversion of gas oil at 600° C. in the process data reported in Table 1 is 0.575 at a C/O of 7 while the average conversion of gas oil at 600° in the process data reported in Table 2 is 0.555 where the overall C/O is 4. At 700° C. the comparison is 0.758 to 0.779. Furthermore, it should be noted that the range of conversions in each stage in Tables 2 and 3 is large. That is, in Table 2, the conversion in stage 1 is 0.787 while the conversion in stage 3 is 0.298. Since the yield patterns in cracking are not linear with conversion, it is important to have the cracking in each stage relatively equal so that there is neither over cracking (to produce lighter $C_2$ components etc.) or under cracking. It is therefore desirable to narrow the band of conversion and this will be seen in the examples which follow.

Tables 4 and 5 illustrate data of the present invention as relating to high C/O ratios. In these examples, there is no feed profile and the residence time per stage is held constant at 2.0 seconds.

TABLE 4

| High C/O Staged Cracking Overall C/O = 7.0 Inlet Solids T = 600° C. | | | |
|---|---|---|---|
| Stage | 1 | 2 | 3 |
| Feed | Gas Oil | Gas Oil | Gas Oil |
| C/O Ratio Per Stage | 21 | 21 | 21 |
| T of Solids In-°C. | 600 | 549 | 498 |
| T of Reaction-°C. | 549 | 498 | 447 |
| Residence Time-Sec | 2 | 2 | 2 |
| Conversion | 0.897 | 0.836 | 0.738 |
| Average Conversion | | 0.824 | |

TABLE 5

| High C/O Staged Cracking Overall C/O = 7.0 Inlet Solids T = 700° C. | | | |
|---|---|---|---|
| Stage | 1 | 2 | 3 |
| Feed | Gas Oil | Gas Oil | Gas Oil |
| C/O Ratio Per Stage | 21 | 21 | 21 |
| T of Solids In-°C. | 700 | 649 | 578 |
| T of Reaction-°C. | 649 | 598 | 547 |
| Residence Time-Sec | 2 | 2 | 2 |
| Conversion | 0.946 | 0.919 | 0.874 |
| Average Conversion | | 0.913 | |

Here it can be seen that by operating at a higher C/O ratio than contemplated by the data of Tables 2 and 3, the conversion is increased considerably and the band or range of conversions in each stage has been narrowed. The present system achieves conversions similar to a single riser system or a low C/O staged system at over 100° C. lower solids temperature. This reduces thermal products and the higher C/O ratio increases the "catalytic content" (isomerization) of the yields. To illustrate the other feature of the invention, Tables 6 and 7 relates to the addition of a residence time profile at 600° C. and 700° C. inlet wherein the first stage has a residence time of 1.5 seconds, the second stage 2.0 seconds and the third stage 3.0 seconds.

TABLE 6

| High C/O Staged Cracking Overall C/O = 7 Inlet Solids T = 600° C. | | | |
|---|---|---|---|
| Stage | 1 | 2 | 3 |
| Feed | Gas Oil | Gas Oil | Gas Oil |
| C/O Ratio Per Stage | 21 | 21 | 21 |
| T of Solids In-°C. | 600 | 549 | 498 |
| T of Reaction-°C. | 549 | 498 | 447 |
| Residence Time-Sec | 1.5 | 2 | 3 |
| Conversion | 0.869 | 0.840 | 0.809 |
| Average Conversion | | 0.839 | |

TABLE 7

| High C/O Staged System Overall C/O = 7 Inlet Solids T = 700° C. | | | |
|---|---|---|---|
| Stage | 1 | 2 | 3 |
| Feed | Gas Oil | Gas Oil | Gas Oil |
| C/O Ratio Per Stage | 21 | 21 | 21 |
| T of Solids In-°C. | 700 | 649 | 598 |
| T of Reaction-°C. | 649 | 598 | 547 |
| Residence Time-Sec | 1.5 | 2 | 3 |
| Conversion | 0.930 | 0.920 | 0.912 |
| Average Conversion | | 0.921 | |

Here as compared to Tables 4 and 5 where there was no residence time profile, the conversions have increased, but only slightly, while the band or spread between conversions in the various stages has been reduced significantly. Therefore, there is a better overall distribution of the desired products. The residence time profile has principally increased the conversions in the later stages. For example, stage 3 of Table 4 has a conversion of 0.738 verses stage 3 of Table 6 where the conversion is 0.809. Reducing the residence times and conversions in the initial stages has a dramatic effect on the extent of catalyst deactivation in that stage. Thus, a more active catalyst is fed to the later stages improving performance.

The Tables 1 to 7 all relate only to the processing of gas oil. However, it is often desired to process other feeds such as naphtha and residual oil by catalytic cracking. The following Table 8 illustrates the cracking of naphtha, gas oil and residual with feed sequencing (naphtha first and residual oil last) in a single riser (such as U.S. Pat. No. 4,422,925) with an initial solids temperature of 725° C.

TABLE 8

| Single Riser - Staged<br>Overall C/O = 7<br>Inlet Solids T = 725° C. | | | |
|---|---|---|---|
| Stage | 1 | 2 | 3 |
| Feed | Naphtha | Gas Oil | Residual |
| C/O Ratio Per Stage | 21 | 14 | 7 |
| T of Solids In-°C. | 725 | 674 | 637 |
| T of Reaction-°C. | 674 | 637 | 599 |
| Residence Time-Sec | 0.5 | 1 | 1 |
| Conversion | 0.518 | 0.846 | 0.729 |

The following Table 9 illustrates the independent staging of invention as applied to the process of these three distinct feeds.

TABLE 9

| Staged Cracking<br>Overall C/O = 7<br>Inlet Solids T = 600° C. | | | |
|---|---|---|---|
| Stage | 1 | 2 | 3 |
| Feed | Naphtha | Gas Oil | Residual |
| C/O Ratio Per Stage | 21 | 21 | 21 |
| T of Solids In-°C. | 600 | 549 | 498 |
| T of Reaction-°C. | 549 | 498 | 447 |
| Residence Time-Sec | 1.5 | 2 | 3 |
| Conversion | 0.577 | 0.848 | 0.865 |

This shows that the temperature can be 125° C. lower and yet even higher conversion levels are achieved using the invention. In the single riser system (Table 8), naphtha is fed initially and sees a high C/O ratio. The lighter naphtha feedstock is more difficult to crack and hence is able to achieve only a low conversion at these conditions. The residence time (0.5 sec) reflects the time prior to the introduction of the second feed (gas oil). In a single riser staged system, introducing the second feed effectively quenches the primary feed since the temperature is reduced even further and the catalyst concentration is diluted (C/O ratio drops from 21 to 14). Table 8 also shows the addition of a residuum feed even further up the riser. This reduces temperatures and dilutes the catalyst even further. Note that the total residence time for the system is 2.5 seconds. This reflects a height typical for a single riser system. In order to obtain longer residence times, increased height and hence pressure would be necessary.

Table 9 illustrates the same three feed system with the present invention employing independent staging, a residence time profile and a feedstock profile. With individual risers, the C/O can be maintained at a high level in all stages increasing conversion. Further, with individual risers, residence times can be utilized for each feed consistent with desired conversion and not limited by height in a single riser. As can be seen, at an overall temperature of 125° C. lower than the single riser case, the present invention achieves higher conversions for both the naphtha and residuum feed. In this example, the inlet solids temperature was selected to achieve the same yield for the gas oil fraction as the conventional single riser.

A similar case could be constructed where the residuum feed was introduced in the first stage. However, due to the high conversions for that feed and the presence of heavier components that tend to increase fouling, the deactivation of the catalyst in that stage would be excessive leading to reduced conversions in subsequent stages. It has been found that the preferred feedstock profile is light to heavy for the present invention.

To illustrate the invention even further, Tables 10 and 11 show the comparison for a feed mix consisting of gas oil and residuum only, a common situation. Table 10 represents a case where two parallel single risers are used with a common regenerator. Each riser can be operated independently to some extent but each must be in heat balance with the common solids temperature. Gas oil is the feed to one riser at a C/O of 7 while residuum is fed to the second riser also at a C/O ratio of 7. Both risers receive solids directly from the regenerator at a temperature of 700° C. Both risers have a residence time of 2 sec and both terminate in a common reaction vessel. This is similar to U.S. Pat. No. 4,422,925.

Table 11 represents the present invention handling the same feed mix utilizing staged cracking at high C/O ratio and a feed and residence time profile. Gas oil is fed to the first two stages and residuum to the last stage. As can be seen, the present invention shows an increase in conversion for both feeds in spite of a 100° C. lower solids temperature. The lower cracking temperatures will result in higher catalytic content to the yields (more isomerization) and also reduced thermal cracking (less light gases) than the comparative parallel single riser cases. This will improve yields and allow for reduced downstream light gas processing.

TABLE 10

| Multiple Risers<br>C/O = 7<br>Inlet Solids Temperature = 700° C. | | |
|---|---|---|
| Riser | 1 | 2 |
| Feed | Gas Oil | Residuum |
| C/O Ratio | 7 | 7 |
| T of Solids In-°C. | 700 | 700 |
| T of Reaction-°C. | 572 | 572 |
| Residence Time-Sec | 2 | 2 |
| Conversion | 0.758 | 0.802 |

TABLE 11

| Stage Cracking<br>Overall C/O = 7.0<br>Inlet Solids T = 600° C. | | | |
|---|---|---|---|
| Stage | 1 | 2 | 3 |
| Feed | Gas Oil | Gas Oil | Gas Oil |
| C/O Ratio Per Stage | 21 | 21 | 21 |
| T of Solids In-°C. | 600 | 549 | 498 |
| T of Reaction-°C. | 549 | 498 | 447 |
| Residence Time-Sec | 2 | 2 | 2 |
| Conversion | 0.869 | 0.840 | 0.858 |
| Average Conversion | 0.854 | | 0.858 |

Another advantage of the present invention is that it can readily be incorporated into existing cracker/regenerator systems. The staged system can be incorporated along side existing units. Furthermore, the vertical orientation of the system (as compared to the low profile system of U.S. Pat. Nos. 4,925,632 and 4,999,100) allows for different riser lengths (and thus different residence times). It also places intermediate vessels at elevations consistent with the pressure heads they need to develop to lift the solids to the next vessel.

The pressure drop for any riser-reactor is equal to the energy required to accelerate the solids from the lower entry velocity to the higher riser velocity plus the energy required to overcome the "head" of solids in the riser. The "Head" of solids is equal to the product of the flowing density times the height of the lift. Higher C/O ratios give higher flowing densities thus give higher pressure drops for a given lift.

In a single riser system, the pressure to lift the solids is provided by the pressure in the regenerator plus the pressure generated by the head of solids in the standpipe leading to the riser. In design, the height of the standpipe is set by the pressure required to overcome the pressure drop in the riser. The pressure in the regenerator is set by the discharge pressure of the compressor with allowances for valves and pressure to overcome regenerator bed depth. For existing units however, with fixed standpipe heights and compressor discharge pressures, there is minimum flexibility to overcome increased riser pressure drops due to higher C/O ratios.

Figure 3:
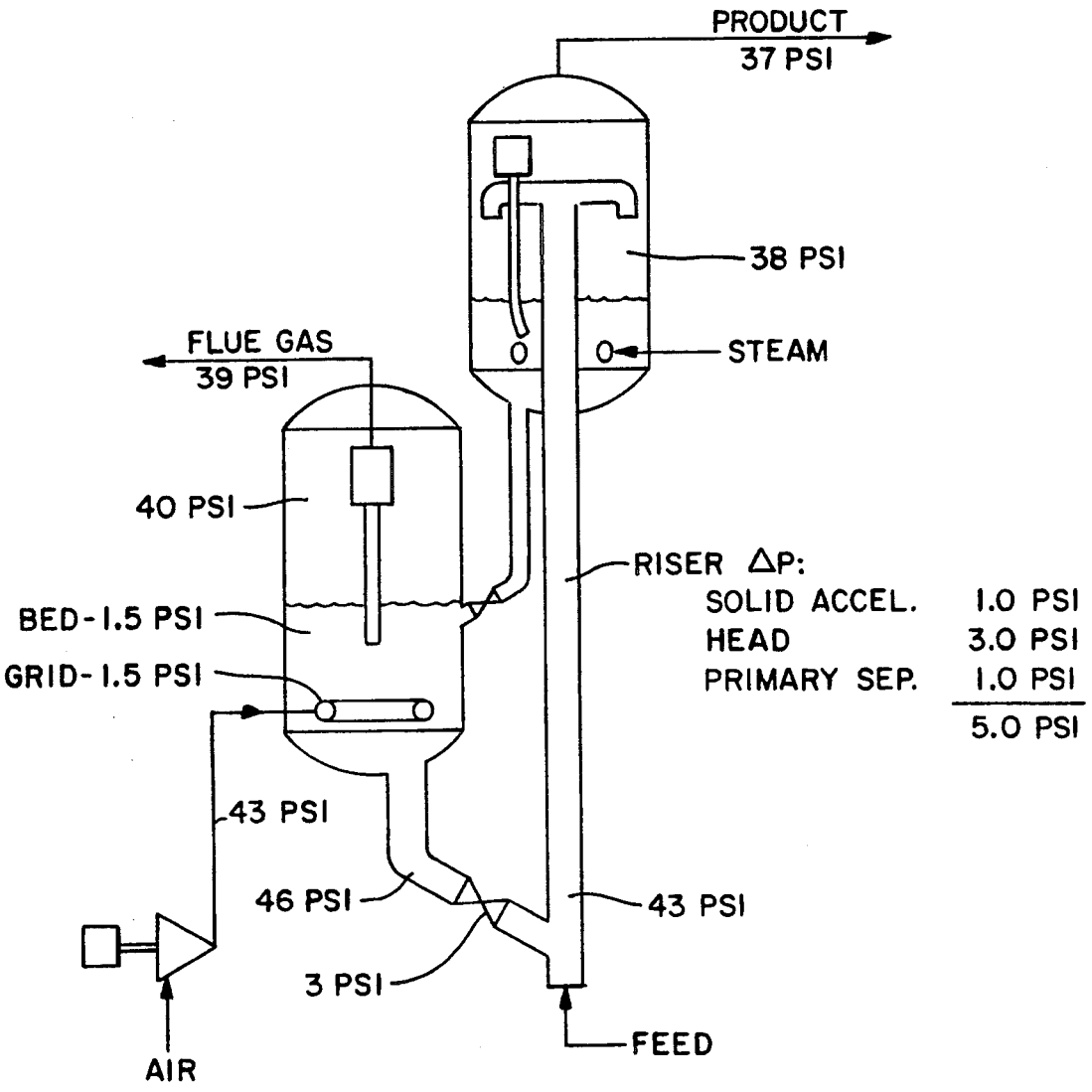
FIG. 3 is a diagrammatic representation of a conventional single riser catalytic cracking system illustrating a pressure balance.

FIG. 3 presents a typical single riser catalytic cracking unit pressure balance. A riser reactor, 160 feet high and operating at a C/O ratio of 7.0, has a pressure drop of approximately 5.0 psi which represents the sum of acceleration pressure drop of 1.0 psi, a primary separation pressure drop of 1.0 psi and a "Head" of 3.0 psi. The pressure at the base of the riser is thus 43 psi based upon a reactor vessel pressure of 38 psi. In order to have 43 psi at the entry to the riser, a certain combination of head of solids (both in a standpipe and regenerator) and regenerator pressure is required. In order to supply the air for regeneration, the air compressor must be able to overcome the regenerator operating pressure, the head of solids in the regenerator bed, and the air distributor pressure drop. For example, a typical pressure for the air entering the distributor in the regenerator might be 43.0 psig.

If the riser was operated at a C/O ratio of 14, the pressure drop in the riser would increase to over 8 psi. Some of this additional pressure drop could be accommodated by reducing valve pressure drop (with subsequent loss of control) but the majority would have to be achieved by either reducing the product discharge pressures or increasing the air compressor discharge. The former would negatively impact the product compression system while the latter would impact the air compressor. In either case, increasing C/O ratio for an existing unit will negatively impact compression requirements. Increased compression means increased horsepower and operating costs.

This limitation is overcome in the present invention by the vertical orientation of the staged system and the residence time profiles associated with each stage. It is assumed that the same pressure is developed at the base of the riser (same air compressor). With a lower residence time in the initial stage, the riser length is shorter while the density is higher due to the higher C/O ratio. In the particular case shown in FIG. 1, the riser pressure drop of riser 18 would be 3.9 psi and the pressure in reactor 24 would be 39.2 psi. The head of solids in vessel 24 would produce additional pressure to allow for the second lift. The pressure at the base of riser 40 would be 42.4 psi, riser 40 would have a pressure drop of 5.4 psi resulting in a pressure of 37 psi in reactor vessel 42.

Note that reactor vessel 42 is elevated allowing sufficient standpipe height to provide for the pressure drop in riser 56. Thus the exit pressure of riser 56 is consistent with the single riser outlet pressure of 35 psi. Further reactor vessel 62 is elevated to allow for solids return to regenerator 10.

The increased pressure drop in the risers of the present invention is accommodated by the vertical arrangement, not be increased air pressure. An essentially lateral staged process, such as contemplated by U.S. Pat. No. 4,999,100, can not effectively be incorporated into existing units.

In general, various details may be incorporated into the present invention. For example, the method and equipment used to separate the catalyst from the product gases is preferably adapted for rapid separation and any desired equipment may be used. Also, the product gases may be quenched before further processing and this quenching may be limited to the hottest gas such as those from the first stage. Although some specific examples have been given for the temperature of the catalyst entering the first stage, the practical temperature range is about 600° C. to 815° C. Further, C/O ratios of greater than 15 and a C/O ratio of 21 have been recited. However, the C/O ratio can be even higher although the practical upper limit is about 40. With respect to residence time profiles, the practical limits for a two stage system is 1 second or less in the first stage and 2 seconds or less in the second stage. For a three stage system, the first stage would be 1 second or less, the second stage would be 0.5 to 1.5 seconds and the third stage would be 1.0 to 3.0 seconds. Other further modifications of the invention could be employed within the spirit and scope of the claims.

I claim:

1. A method of cracking hydrocarbonaceous feedstock, the method comprising the steps of:

a) separating said hydrocarbonaceous feedstock into at least a first feed portion having a lower molecular weight and a second feed portion having a higher molecular weight;

b) passing hot regenerated catalyst particles from a catalyst regenerator to the bottom portion of a first riser reactor and injecting the first feed portion so as to form a catalyst to feed weight ratio of at least 15;

c) passing said catalyst particles and first feed portion up through said first riser reactor and into a first reactor vessel whereby said first feed portion is cracked and said catalyst particles are partially spent;

d) separating said cracked first feed portion from said catalyst particles and discharging said cracked first feed portion;

e) passing said catalyst particles from said first reactor vessel to the bottom portion of a second riser reactor and injecting the second feed portion so as to form a catalyst to feed weight ratio of at least 15;

f) passing said catalyst particles and second feed portion up through said second riser reactor and into a second reactor vessel whereby said second feed portion is cracked and said catalyst particles are further spent;

g) separating said cracked second feed portion from said catalyst particles and discharging said cracked second feed portion; and h) returning said catalyst particles to said regenerator and regenerating said catalyst particles.

2. The method of claim 1 wherein the residence time of said first feed portion in said first riser reactor is less than the residence time of said second feed portion in said second riser reactor.

3. The method of claim 2 wherein said residence time of said first feed portion in said first riser reactor is 1 second or less and said residence time of said second feed portion in said second riser reactor is 2 seconds or less.

4. The method of claim 1 wherein said catalyst to feed ratio in said first and second riser reactors is at least 21.

5. The method of claim 4 wherein the residence time of said first feed portion in said first riser reactor is less than the residence time of said second feed portion in said second riser reactor.

6. The method of claim 5 where said residence time of said first feed portion in said first riser reactor is 1 second or less and said residence time of said second feed portion in said second riser reactor is 2 seconds or less.

7. The method of claim 2 wherein said first feed portion is a vacuum gas oil and said second feed portion is a residual oil.

8. The method of claim 5 where said first feed portion is a vacuum gas oil and said second feed portion is a residual oil.

9. The method of claim 1 wherein step (a) further includes the step of providing a third feed portion which has a higher molecular weight than said second feed portion and wherein step (h) further includes the steps of passing said catalyst particles from said second reactor vessel to the bottom portion of a third riser reactor and injecting said third feed portion so as to form a catalyst to feed weight ratio of at least 15; passing said catalyst particles and said third feed portion up through said third riser reactor and into a third reactor vessel whereby said third feed portion is cracked and said catalyst particles are even further spent, and separating said cracked third feed portion from said catalyst particles and discharging said cracked third feed portion prior to returning said catalyst particles to said regenerator.

10. The method of claim 9 wherein the residence time of said second feed portion in said second riser reactor is greater than the residence time of said first feed portion in said first riser reactor and less than the residence time said third feed portion in said third riser reactor.

11. The method of claim 10 wherein said residence time of said first feed portion in said first riser reactor is 1 second or less, the residence time of said second feed portion in said second riser rector is 0.5 to 1.5 seconds and said residence time of said third feed portion in said third riser reactor is 1.0 to 3.0 seconds.

12. The method of claim 9 where said catalyst to feed ratio in said first, second and third riser reactors is at least 21.

13. The method of claim 12 wherein the residence time of said second feed portion in said second riser reactor is greater than the residence time of said first feed portion in said first riser reactor and less than the residence time said third feed portion in said third riser reactor.

14. The method of claim 10 wherein said first and second feed portions are gas oil and said third feed portion is residual oil.

15. The method of claim 10 wherein said first feed portion is naphtha. said second feed portion is gas oil and said third feed portion is residual oil.

* * * * *